US012760926B2

(12) United States Patent
Eicher et al.

(10) Patent No.: US 12,760,926 B2
(45) Date of Patent: Oct. 13, 2026

(54) CONDENSATE REMOVAL SYSTEMS FROM SELF-CONTAINED HEAT PUMP ROOM CONDITIONING UNITS

(71) Applicant: Rheem Manufacturing Company, Atlanta, GA (US)

(72) Inventors: Kevin Lyle Eicher, Seguin, TX (US); Aaron Patrick Gorman, New Braunfels, TX (US); Geethakrishnam Vasudevan, Sugar Land, TX (US); Alfredo Ojeda, Jr., San Antonio, TX (US); Noah Gunnison Trent, San Antonio, TX (US)

(73) Assignee: Rheem Manufacturing Company, Atlanta, GA (US)

( * ) Notice: Subject to any disclaimer, the term of this patent is extended or adjusted under 35 U.S.C. 154(b) by 131 days.

(21) Appl. No.: 18/847,489

(22) PCT Filed: Mar. 15, 2023

(86) PCT No.: PCT/US2023/015278
§ 371 (c)(1),
(2) Date: Sep. 16, 2024

(87) PCT Pub. No.: WO2023/177727
PCT Pub. Date: Sep. 21, 2023

(65) Prior Publication Data

US 2025/0198650 A1 Jun. 19, 2025

Related U.S. Application Data

(60) Provisional application No. 63/320,426, filed on Mar. 16, 2022.

(51) Int. Cl.
*F24F 13/22* (2006.01)

(52) U.S. Cl.
CPC ..... *F24F 13/224* (2013.01)

(58) Field of Classification Search
CPC .. F24F 13/224; F24F 1/039; F24F 1/42; F24F 2013/225; F24F 11/42; F24F 13/082;
(Continued)

(56) References Cited

U.S. PATENT DOCUMENTS 2,899,803 A 8/1959 Paley
4,067,206 A 1/1978 Smith
(Continued)

FOREIGN PATENT DOCUMENTS

CN 108800347 A * 11/2018 ..... F24F 11/89
KR 102119531 B1 * 6/2020 ..... F24F 6/14

OTHER PUBLICATIONS

Machine English language translation of KR102119531 to Won. Translated Mar. 2026 (Year: 2020).*
(Continued)

*Primary Examiner* — Cassey D Bauer
(74) *Attorney, Agent, or Firm* — Eversheds Sutherland (US) LLP

(57) ABSTRACT

An air conditioning unit is disclosed for use in an opening of a building. The air conditioning unit includes an indoor portion configured to be position on an internal portion of the building and having an indoor heat exchanging coil, an outdoor portion configured to be position on an external portion of the building and having an outdoor heat exchanging coil, and a water dispensing mechanism configured to externally disperse condensate from within the outdoor portion.

17 Claims, 15 Drawing Sheets

(58) Field of Classification Search
CPC ..... F24F 2013/205; F24F 2013/202; F24F 1/027; F25B 31/006
See application file for complete search history.

(56) References Cited

U.S. PATENT DOCUMENTS

| | | | | | |
|---|---|---|---|---|---|
| 4,884,416 | A * | 12/1989 | Hwang | F24F 8/90 | 55/318 |
| 5,461,880 | A * | 10/1995 | Bolton | F24F 13/20 | 62/262 |
| 6,065,299 | A | 5/2000 | Chen | | |
| 2003/0041604 | A1 | 3/2003 | Jang | | |
| 2004/0168461 | A1* | 9/2004 | Park | F24F 1/027 | 62/262 |

OTHER PUBLICATIONS

Machine English language translation of CN108800347 to Guo. Translated Mar. 2026 (Year: 2018).*
International Search Report and the Written Opinion of the International Application No. PCT/US2023/015278 dated Jul. 21, 2023.

* cited by examiner

CONDENSATE REMOVAL SYSTEMS FROM SELF-CONTAINED HEAT PUMP ROOM CONDITIONING UNITS

CROSS-REFERENCE TO RELATED APPLICATIONS

The present disclosure claims priority to and the benefit of U.S. provisional patent application Ser. No. 63/320,426, filed Mar. 16, 2022, which is hereby incorporated by reference herein in its entirety.

FIELD

The present disclosure relates generally to room conditioning (e.g., heating and cooling) units and more particularly to systems and methods for removal of condensate from self-contained heat pump room conditioning units, such as saddle window heat pump conditioning units or the like.

BACKGROUND

Self-contained room conditioning units can be employed to heat a specific room or other area within a building. Typically, such units are positioned in an opening of a building envelope, such as in a window. In some instances, self-contained room conditioning units can include a heat pump and can straddle the envelope opening such that a first heat exchanger of the heat pump system is located on an indoor side of the building envelope and a second heat exchanger of the heat pump system is located on an outdoor side of the building envelope.

Such systems can be particularly useful in older buildings that do not have a central heating and/or cooling system or buildings that have a central heating and/or cooling system that is unable to sufficiently meet the heating and/or cooling demand of a given room or other area within the building. As will be appreciated, heat pump systems can often generate condensate via the heat exchanger coils, and traditionally, self-contained room conditioning units including a heat pump are designed to simply permit condensate to drip out of the outdoor portion of the conditioning unit. This can be problematic, however. For example, it can be undesirable for water to drip below the outdoor portion of a conditioning unit, such as if a sidewalk is located below the outdoor portion of the conditioning unit. This can be particularly undesirable in colder climates, where icicles or ice sheets can form from the dripping condensate.

BRIEF DESCRIPTION OF THE FIGURES

The accompanying drawings, which are incorporated in and constitute a part of this specification, illustrate various aspects of the presently disclosed subject matter and serve to explain the principles of the presently disclosed subject matter. The drawings are not intended to limit the scope of the presently disclosed subject matter in any manner.

FIG. IF illustrates a bottom view of an example room conditioning unit in accordance with one or more embodiments of the present disclosure.

Figure 1A:
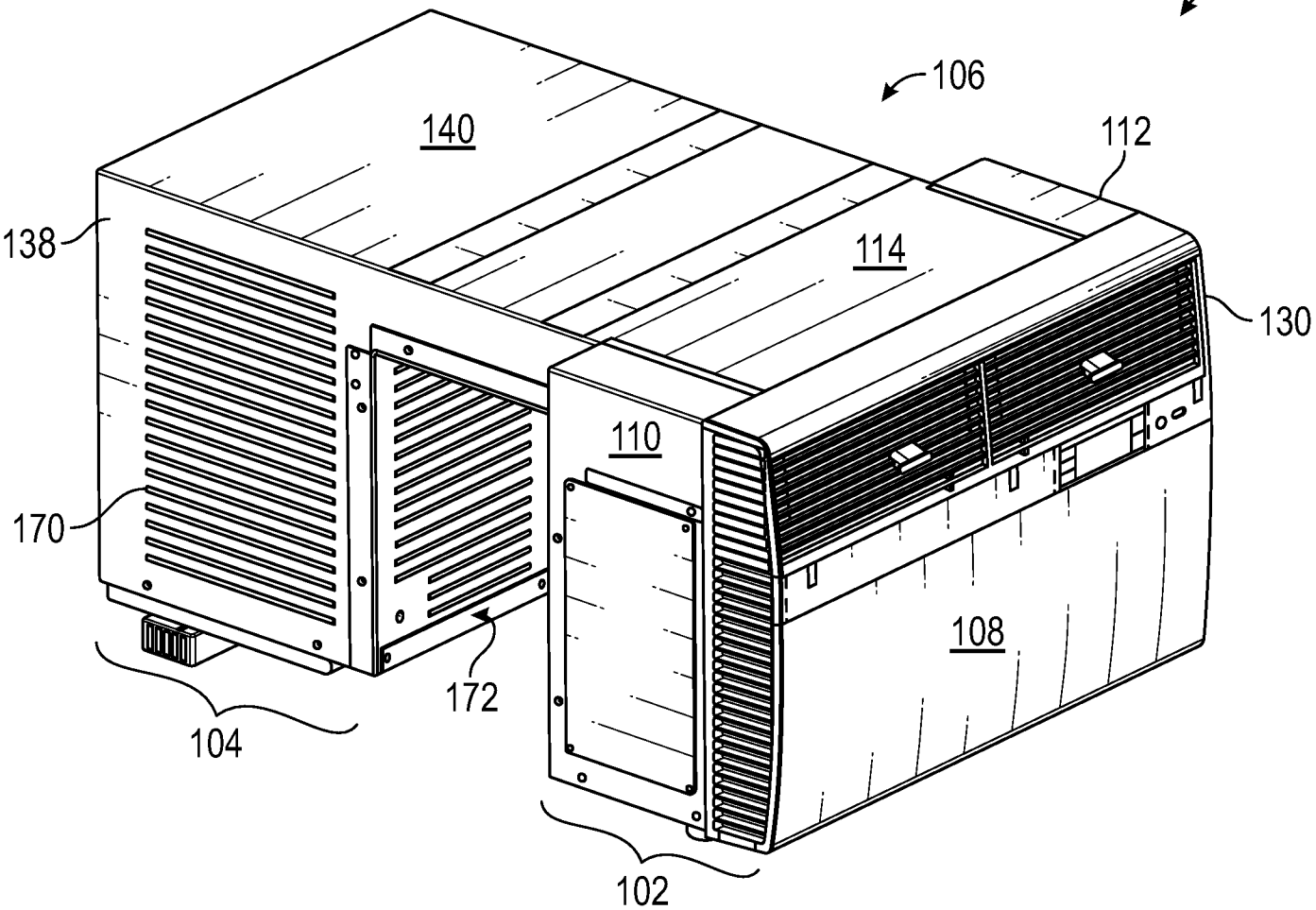
FIG. 1A illustrates a first perspective view of an example room conditioning unit in accordance with one or more embodiments of the present disclosure.
Figure 1B:
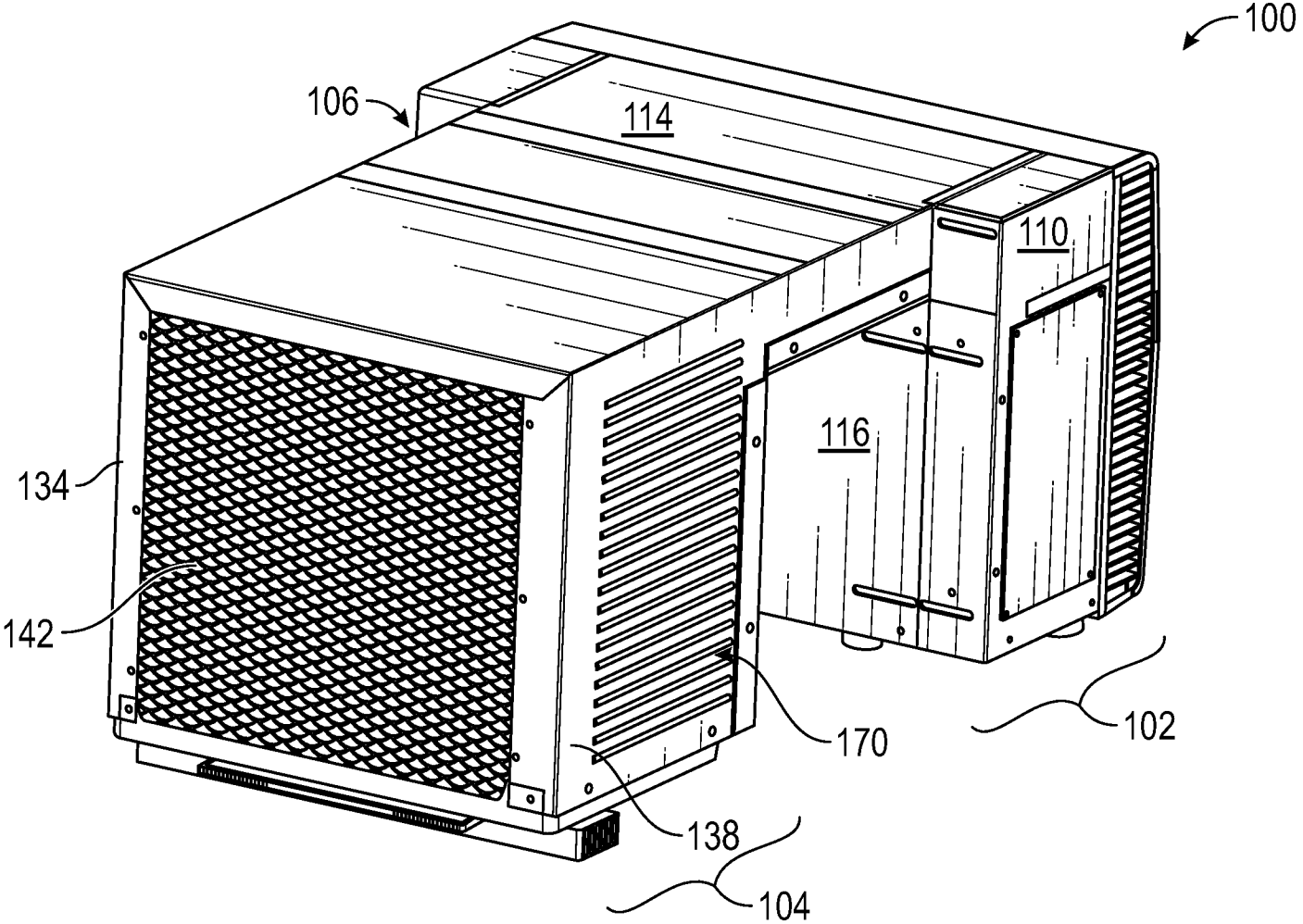
FIG. 1B illustrates a second perspective view of an example room conditioning unit in accordance with one or more embodiments of the present disclosure.
Figure 1C:
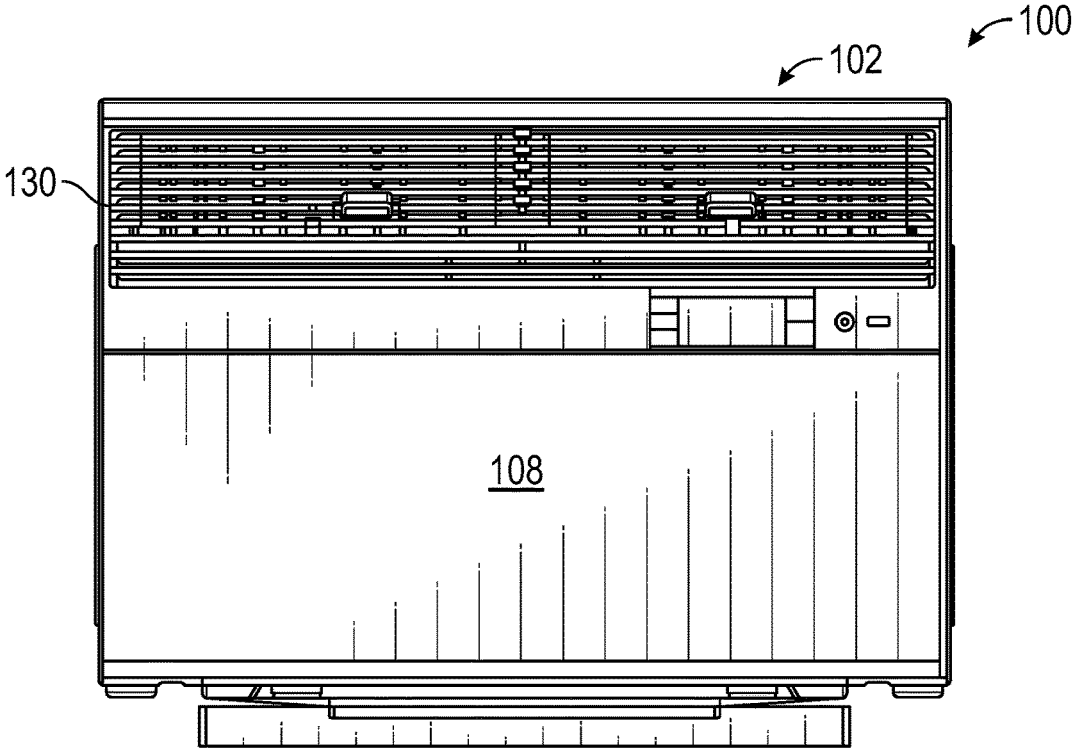
FIG. 1C illustrates an elevation view from an indoor portion perspective of an example room conditioning unit in accordance with one or more embodiments of the present disclosure.
Figure 1D:
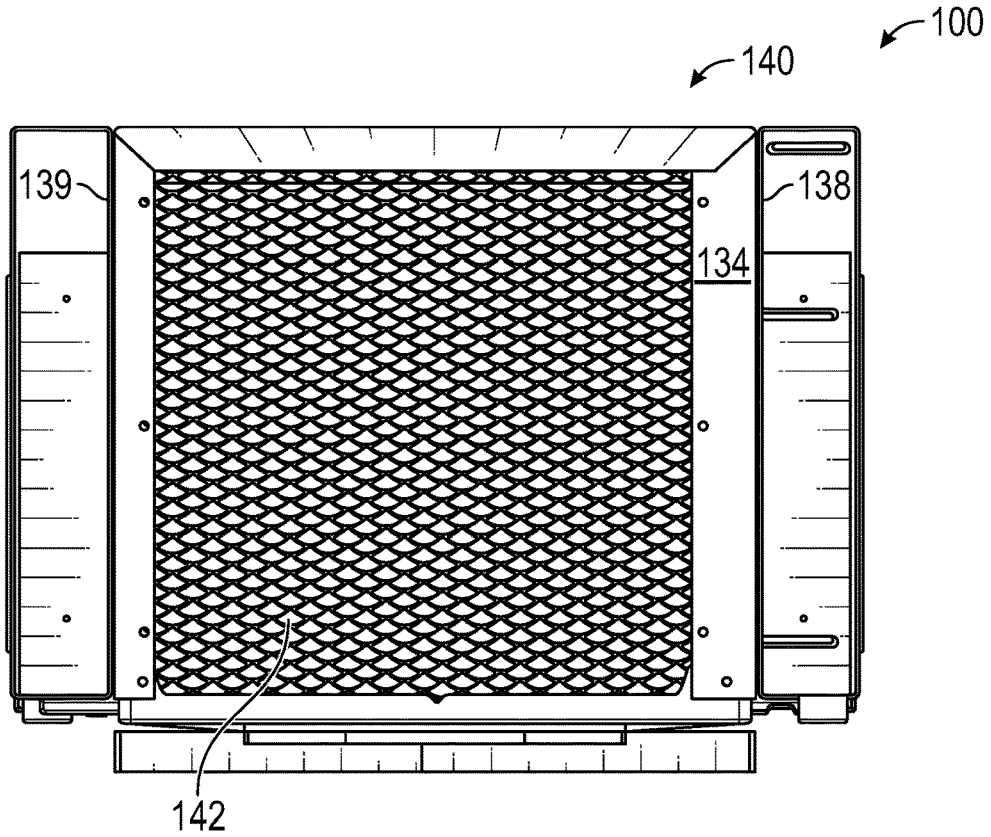
FIG. 1D illustrates an elevation view from an outdoor portion perspective of an example room conditioning in accordance with one or more embodiments of the present disclosure.
Figure 1E:
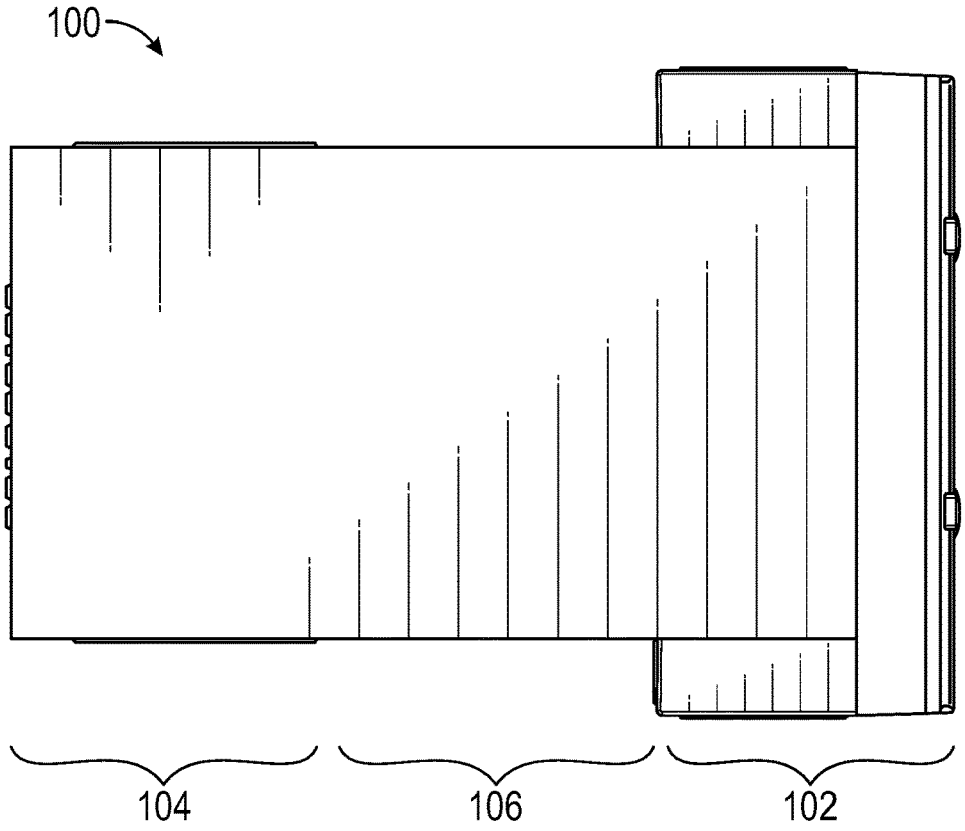
FIG. 1E illustrates a top view of an example room conditioning unit in accordance with one or more embodiments of the present disclosure.
Figure 1F:
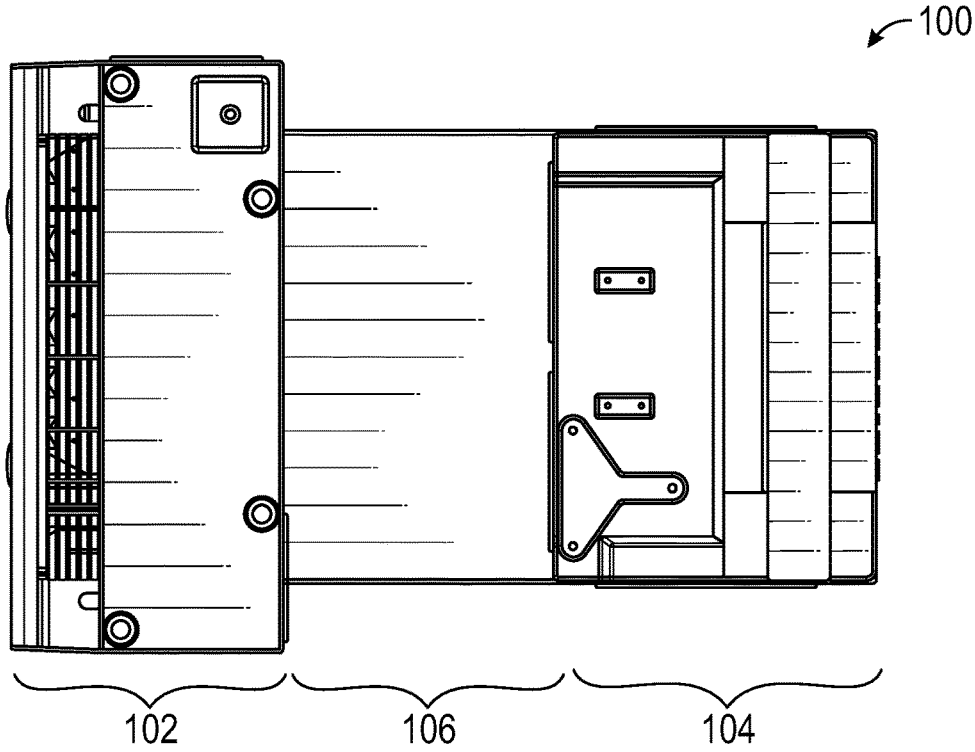
Figure 1G:
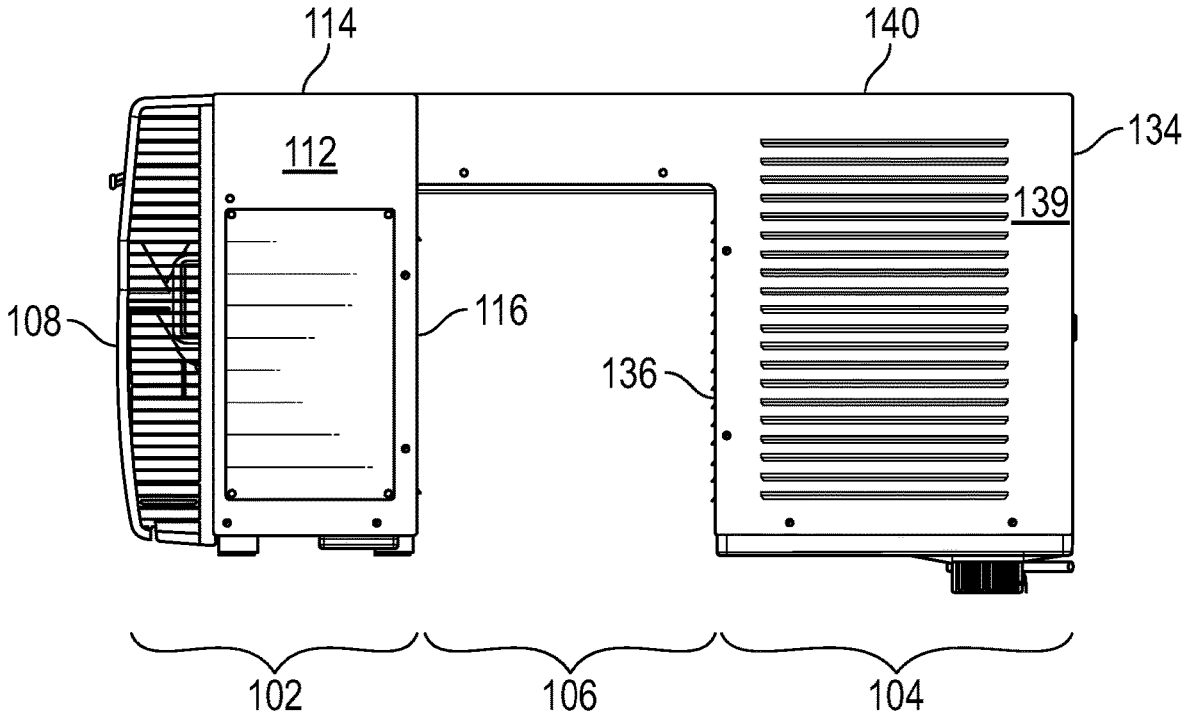

FIG. 1G illustrates a first side view of an example room conditioning unit in accordance with one or more embodiments of the present disclosure.

Figure 1H:
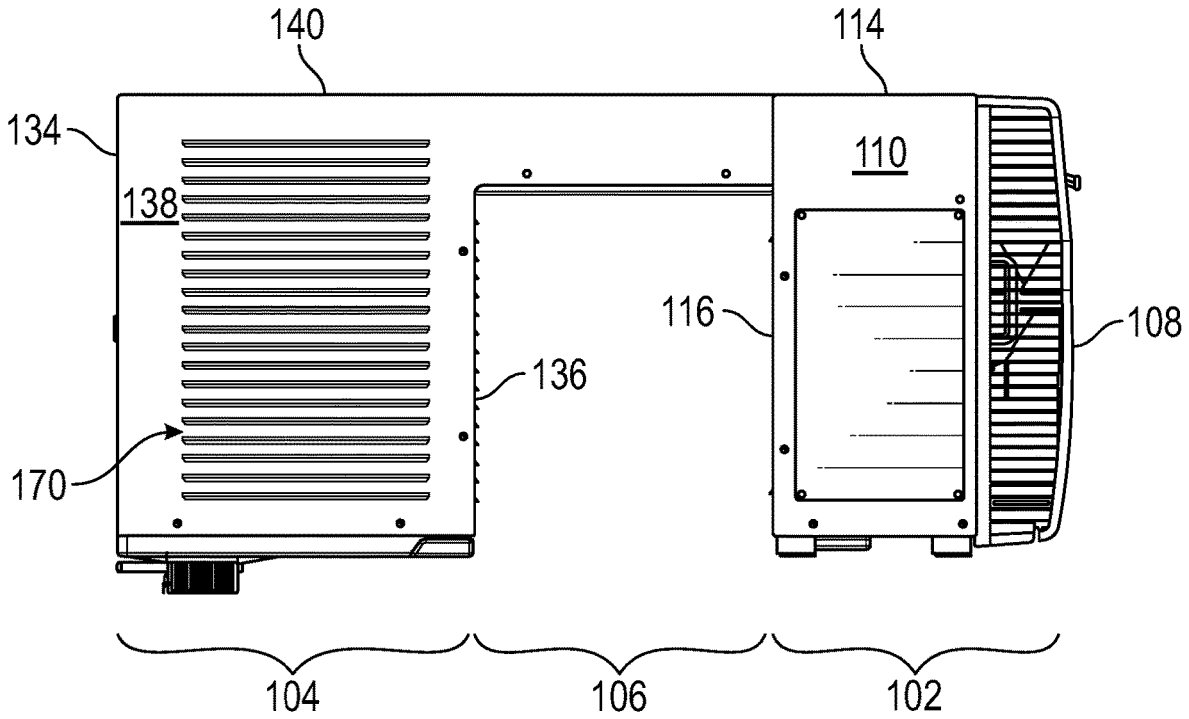

FIG. 1H illustrates a second side view of an example room conditioning unit in accordance with one or more embodiments of the present disclosure.

Figure 1I:
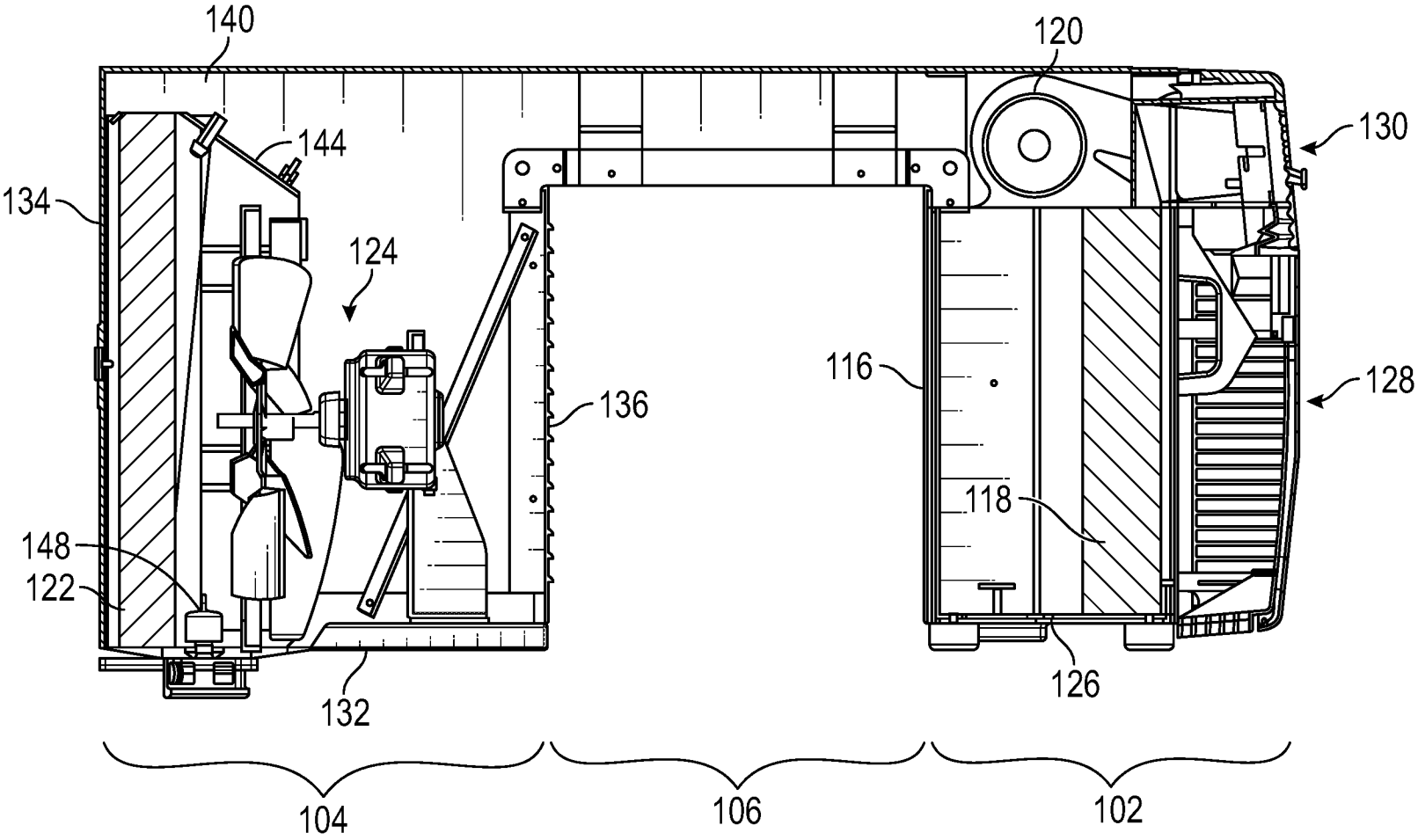

FIG. 1I illustrates a cross-sectional view of an example room conditioning unit in accordance with one or more embodiments of the present disclosure.

Figure 2A:
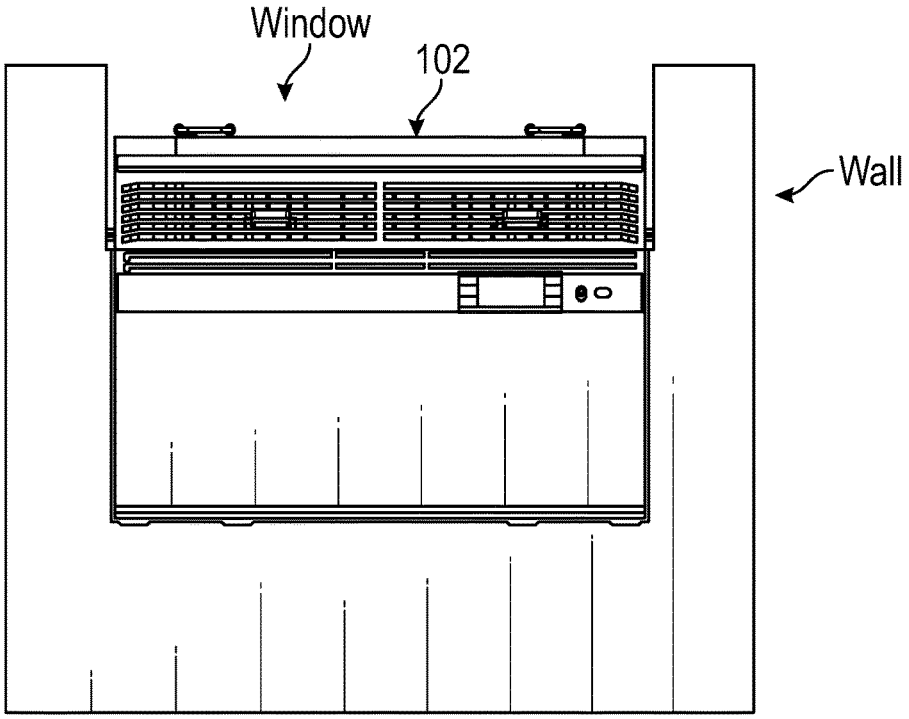
Figure 2B:
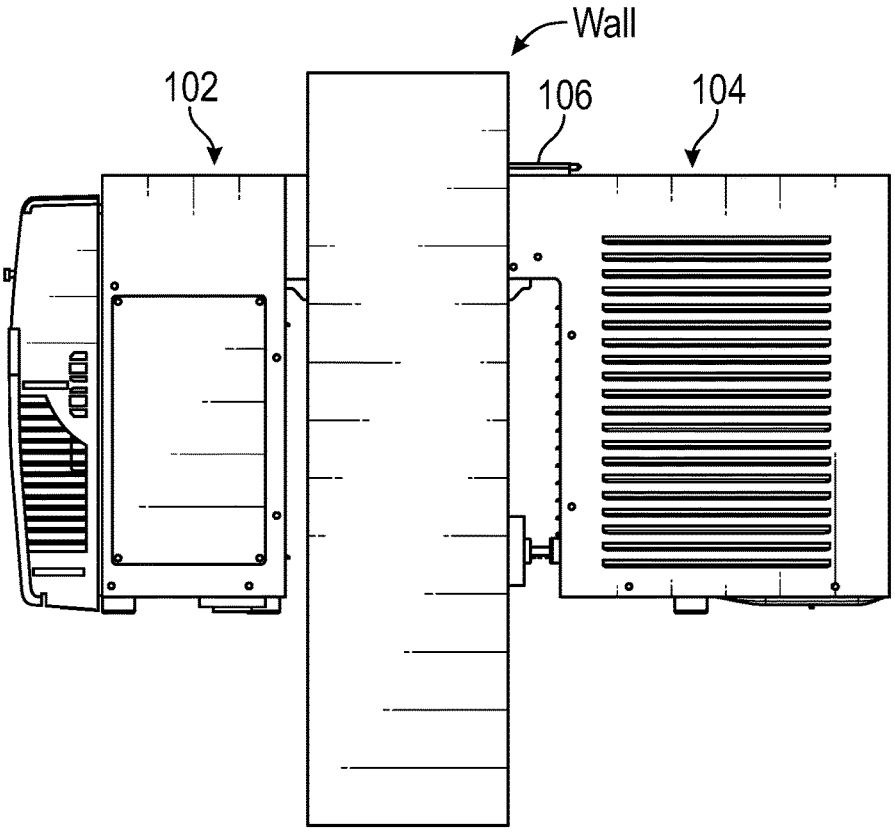

FIGS. 2A and 2B illustrate an elevation view and a side view, respectively, of an example room conditioning unit installed in a window in accordance with one or more embodiments of the present disclosure.

Figure 3A:
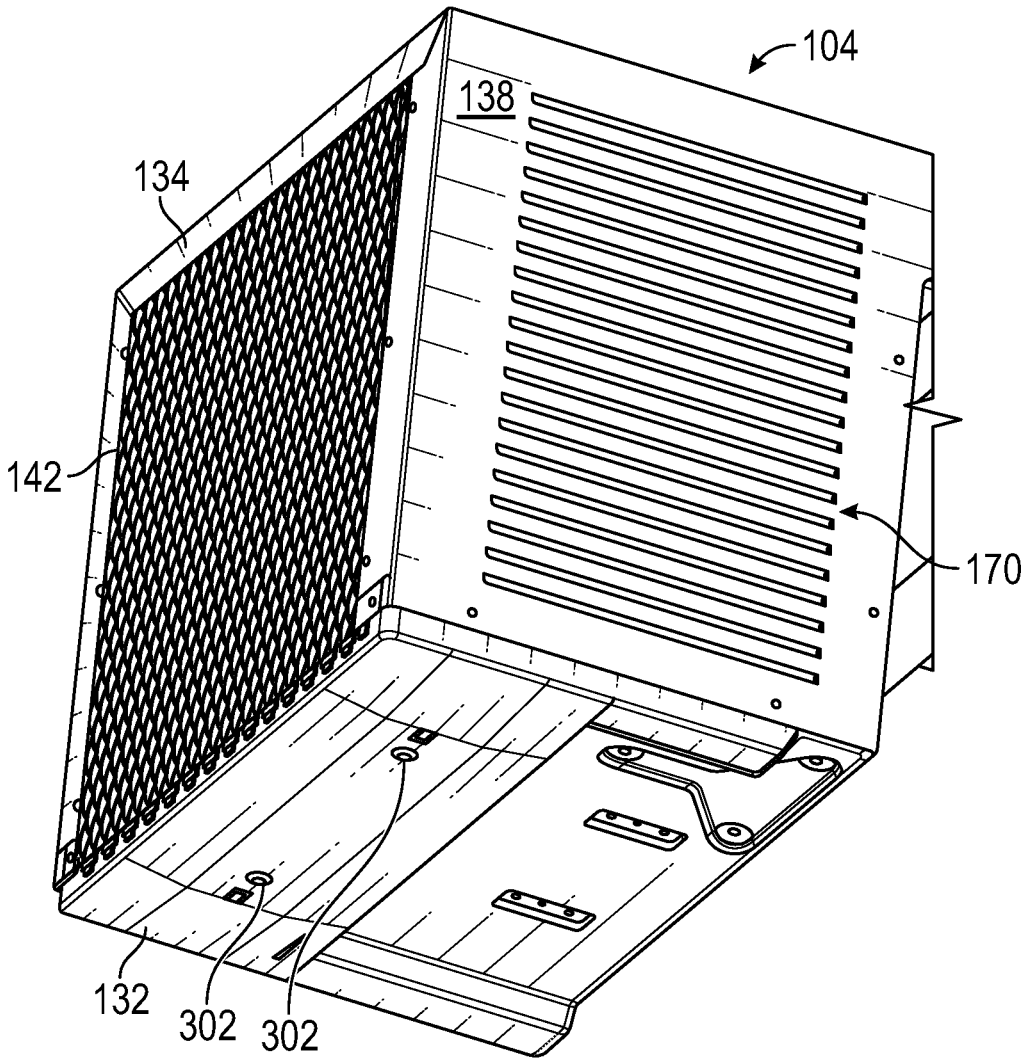

FIG. 3A illustrates a bottom perspective view of an outdoor portion of an example room conditioning unit in accordance with one or more embodiments of the present disclosure.

Figure 3B:
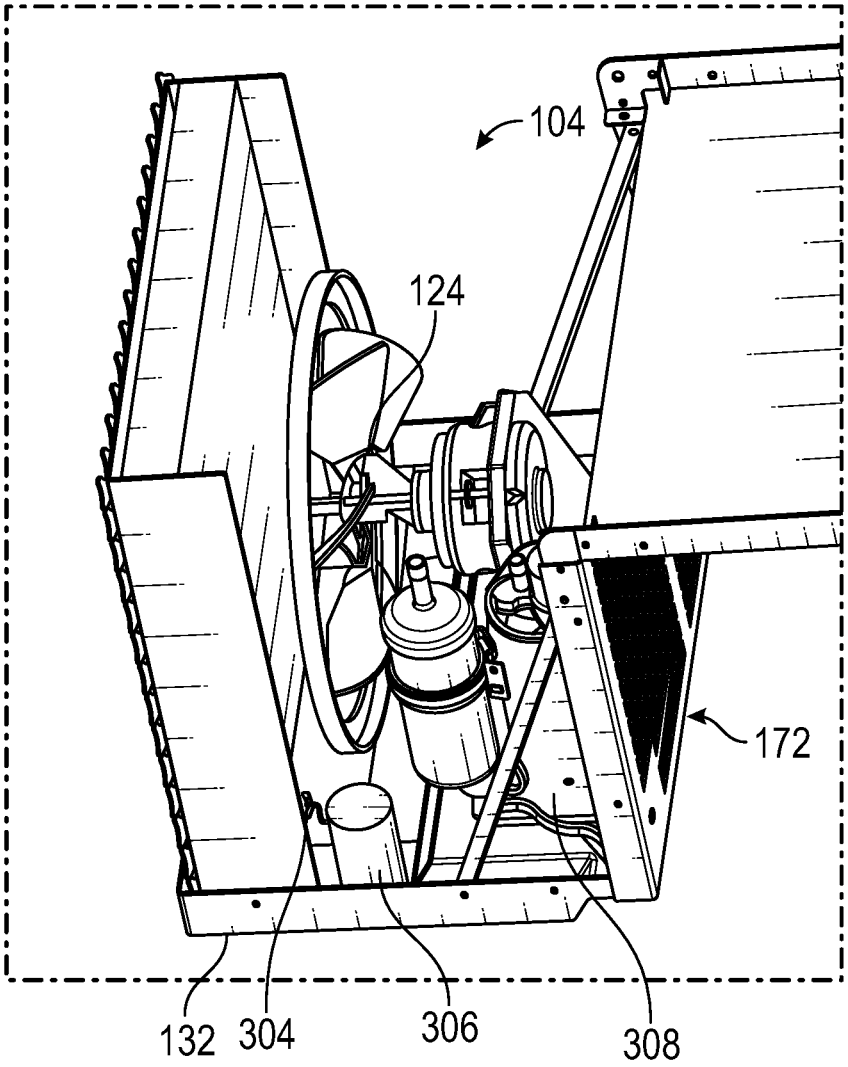

FIG. 3B illustrates a top perspective view of an outdoor portion of an example room conditioning unit with the top and outer walls of the outdoor portion removed for clarity of illustration in accordance with one or more embodiments of the present disclosure.

Figure 4A:
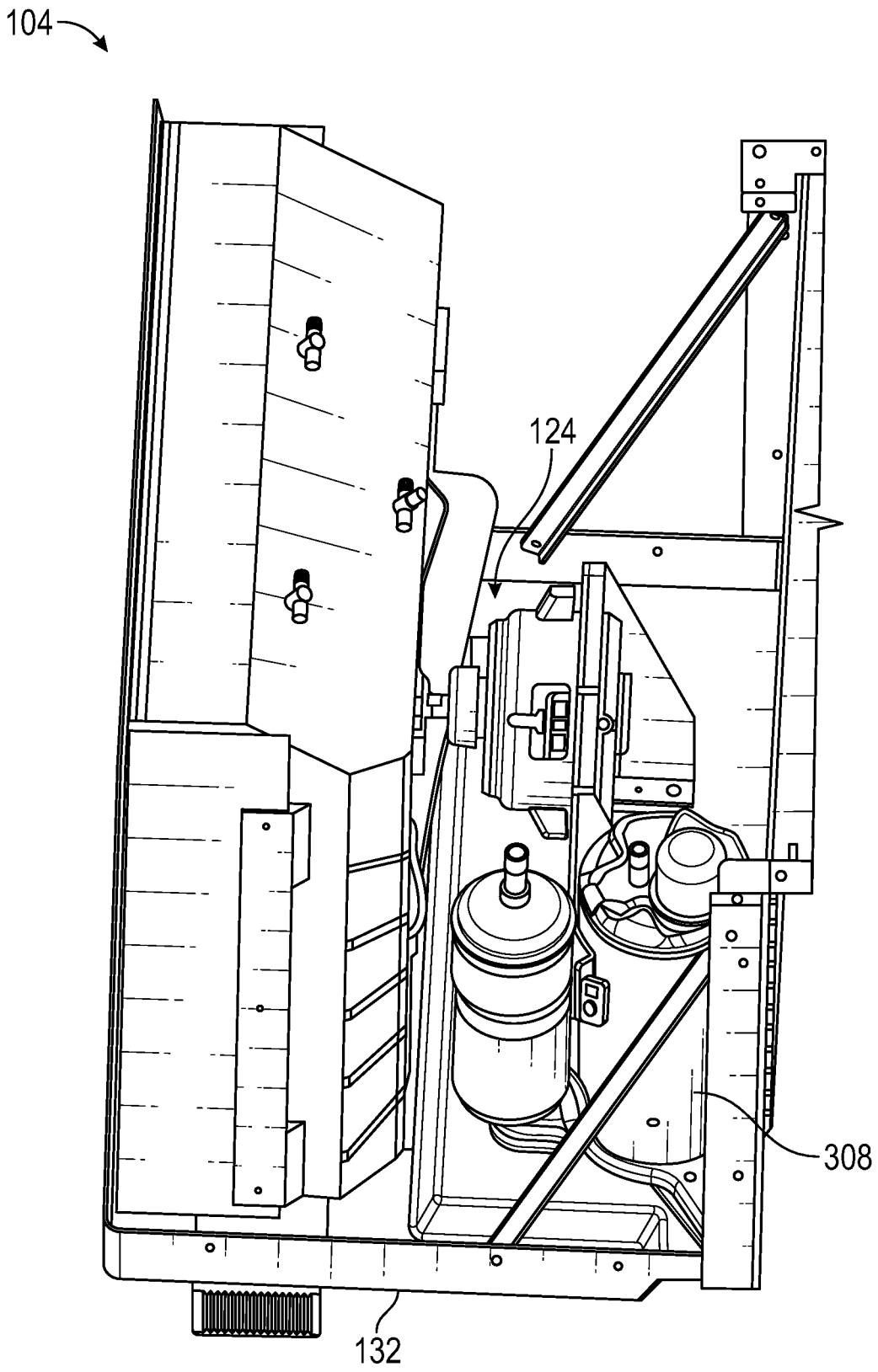

FIG. 4A illustrates a top perspective view of an outdoor portion of an example room conditioning unit with the top and outer walls of the outdoor portion removed for clarity of illustration in accordance with one or more embodiments of the present disclosure.

Figure 4B:
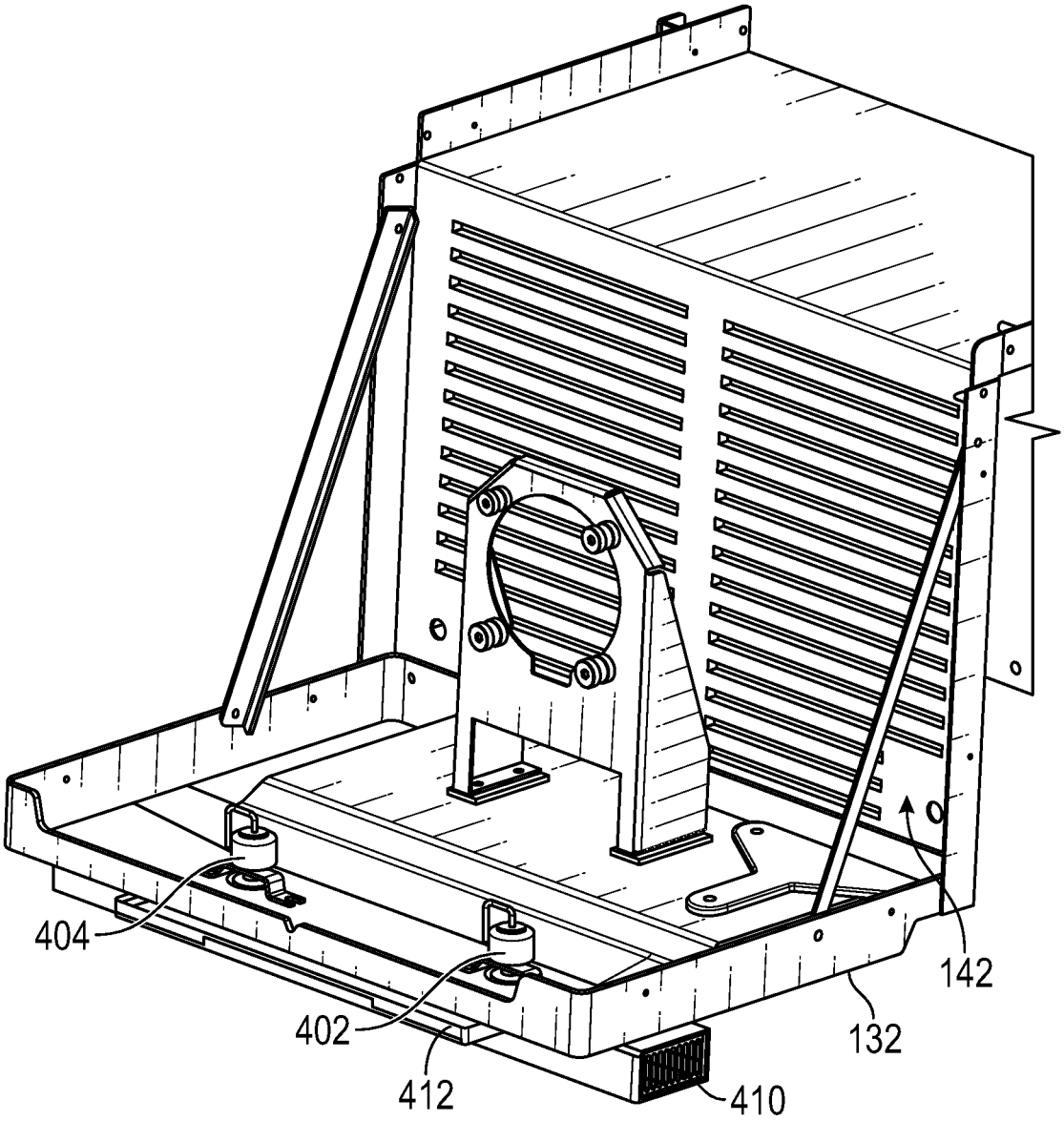

FIG. 4B illustrates a top perspective view of an outdoor portion of an example room conditioning unit with the top and outer walls of the outdoor portion and certain internal components removed for clarity of illustration in accordance with one or more embodiments of the present disclosure.

Figure 4C:
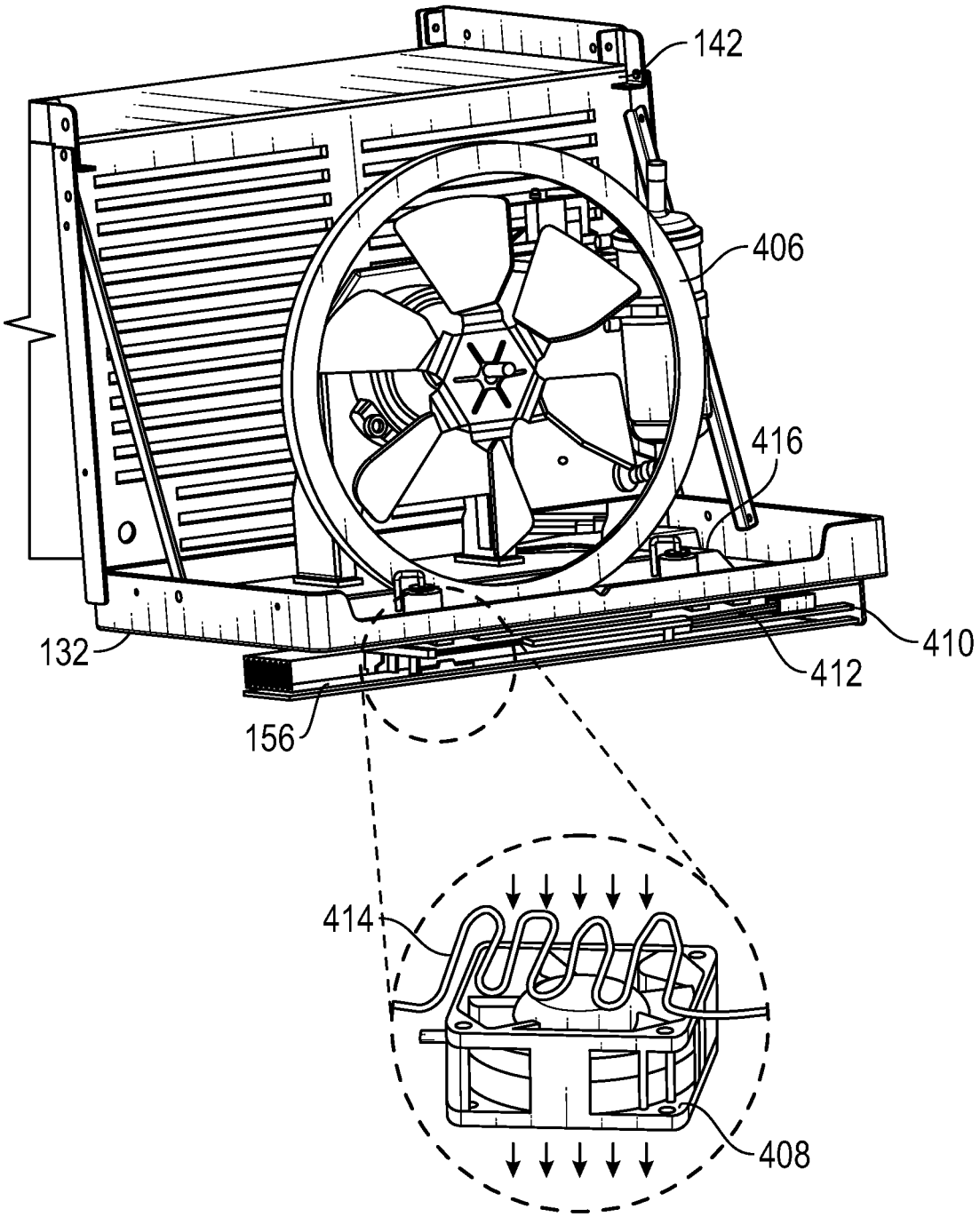

FIG. 4C illustrates a perspective view of an outdoor portion of an example room conditioning unit with the top and outer walls of the outdoor portion and certain internal components removed or shown as transparent for clarity of illustration in accordance with one or more embodiments of the present disclosure.

Figure 5:
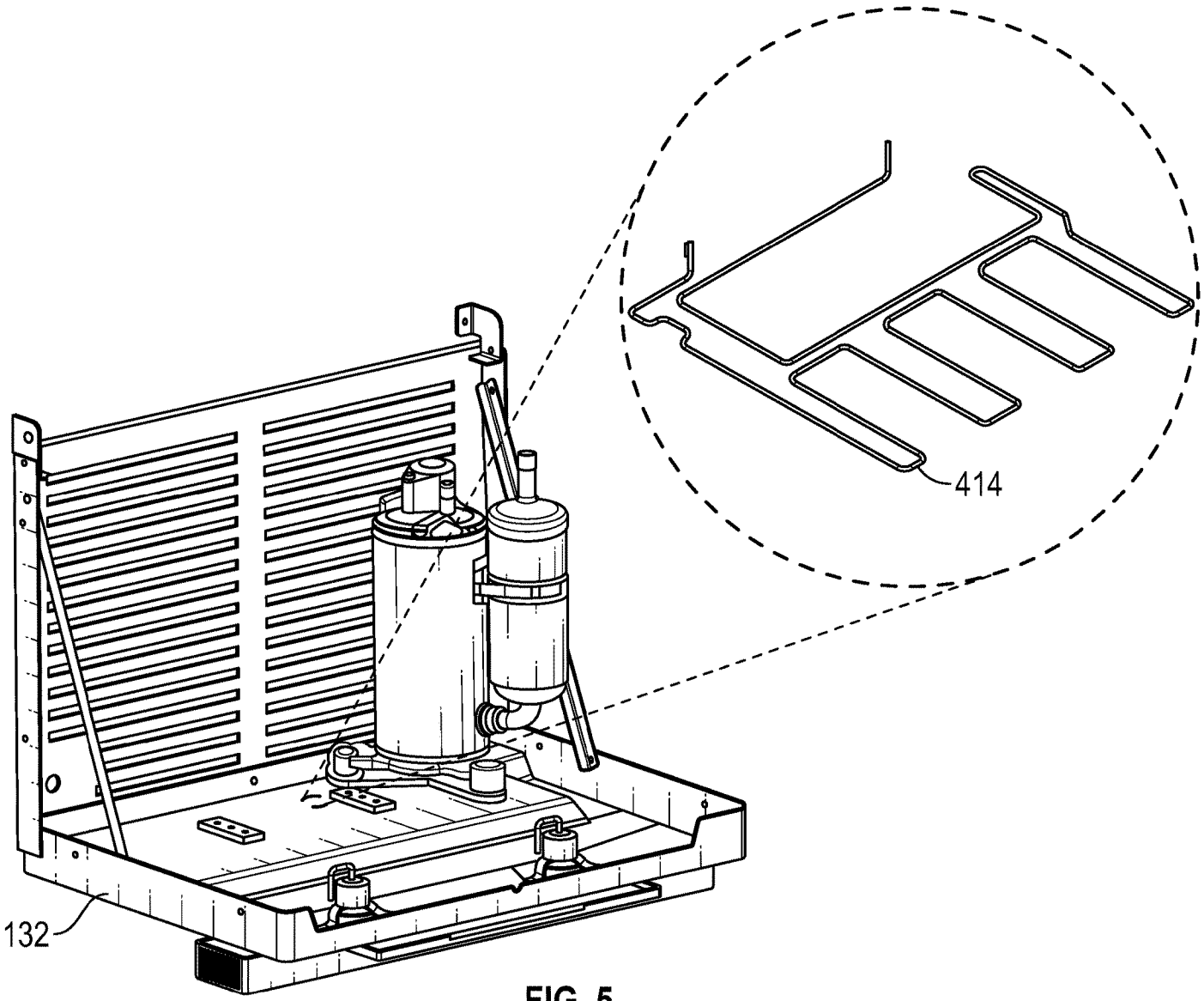

FIG. 5 illustrates a perspective view of an outdoor portion of an example room conditioning unit with the top and outer walls of the outdoor portion and certain internal components removed for clarity of illustration in accordance with one or more embodiments of the present disclosure.

Figure 6A:
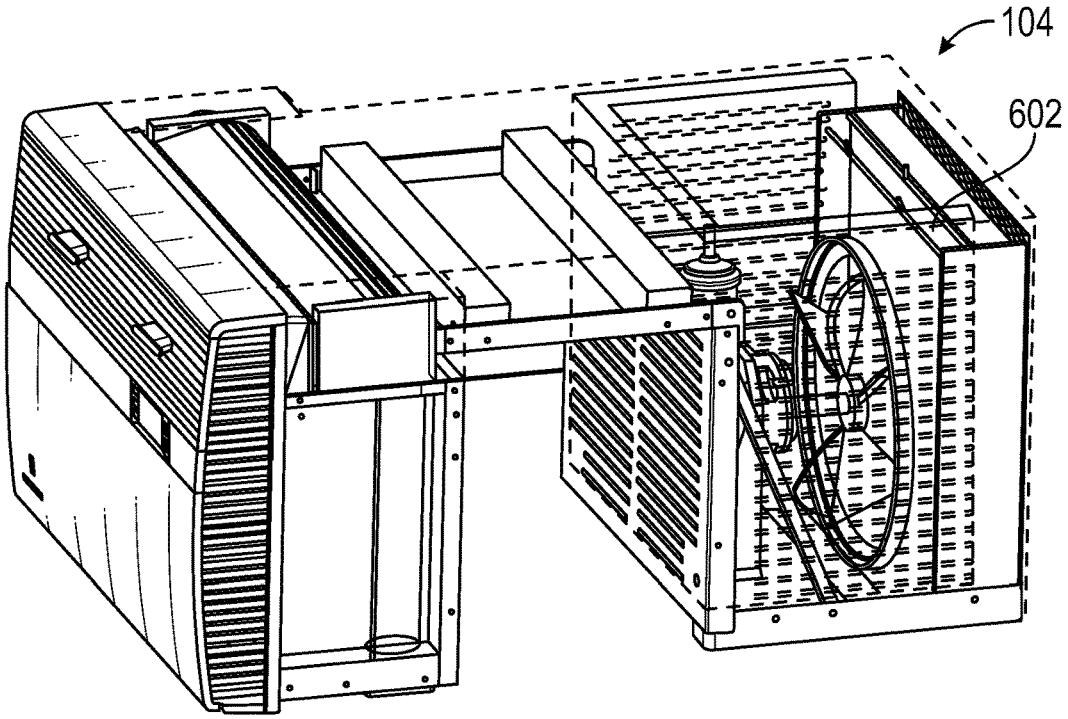
Figure 6B:
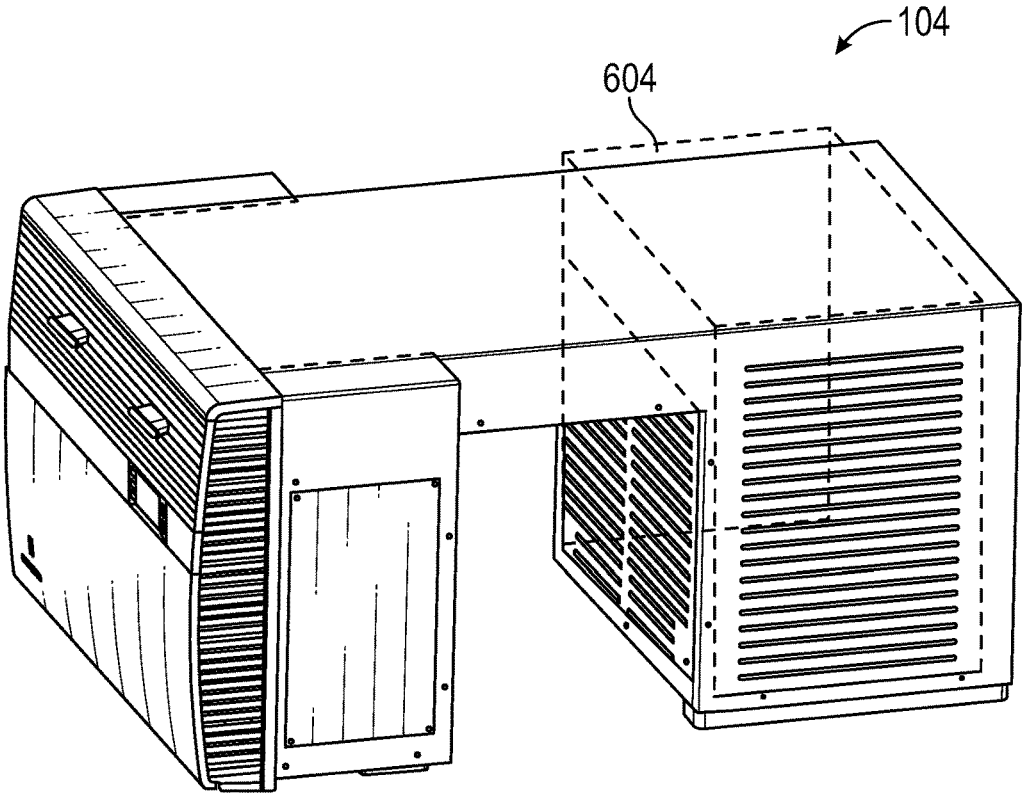

FIGS. 6A and 6B illustrate perspective views, with inner components illustrated and with inner components removed, respectively, of an example room conditioning unit having air filters for the outdoor portion in accordance with one or more embodiments of the present disclosure.

Figure 7C:
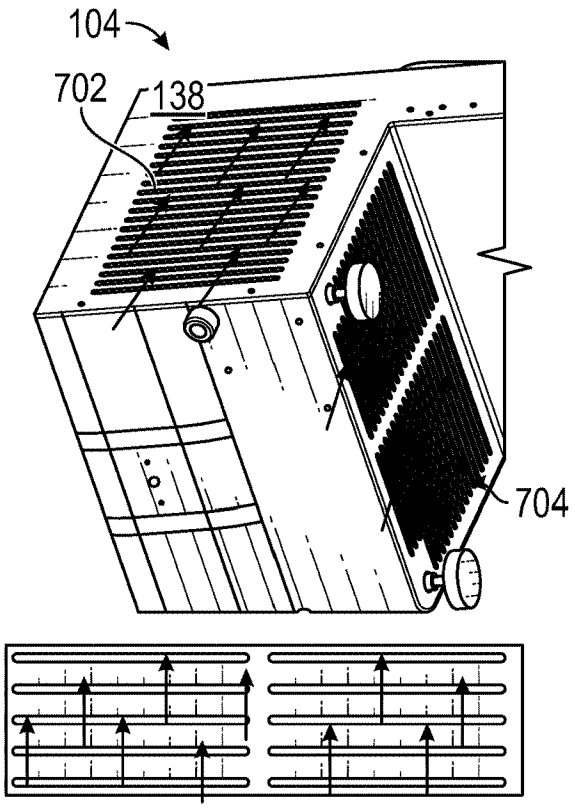
Figure 7B:
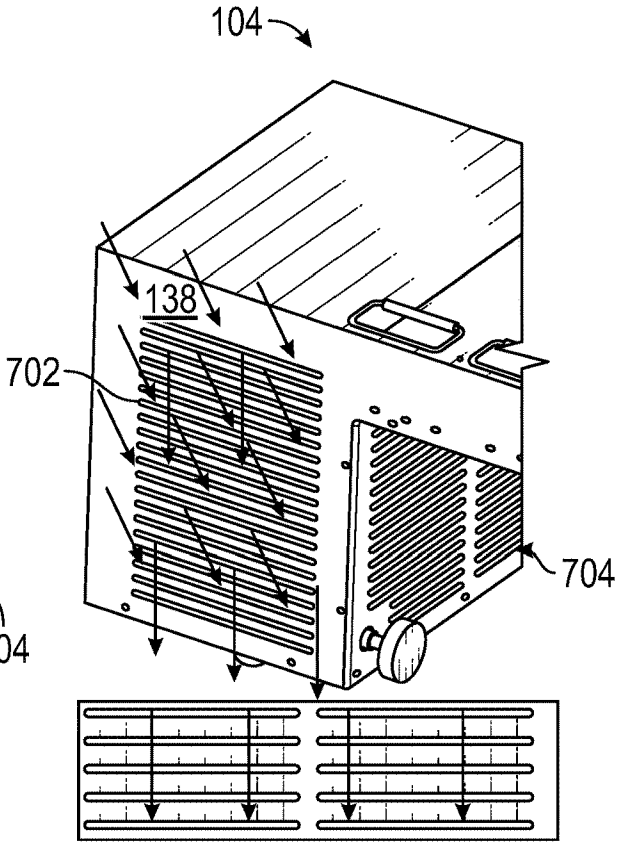
Figure 7A:
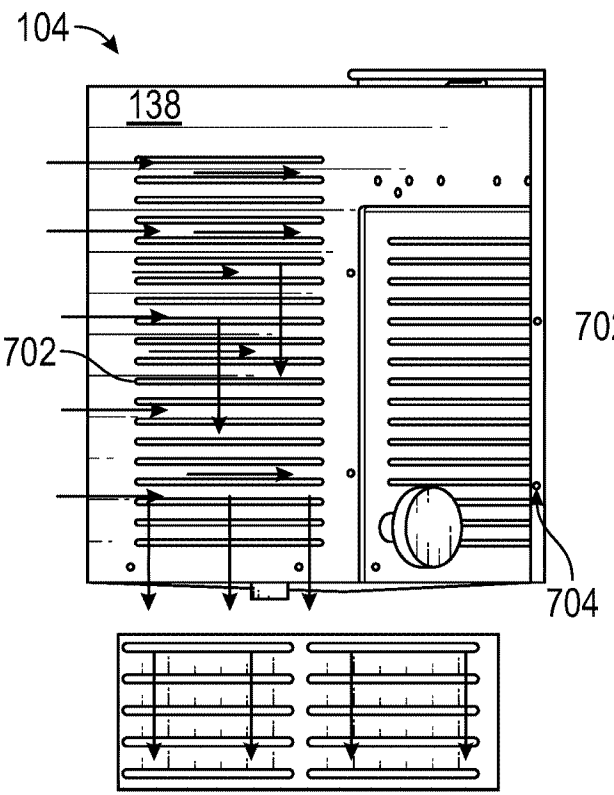

FIGS. 7A-7C illustrate, a side perspective view, a top side perspective view, and a bottom side perspective view, respectively, of an example room conditioning unit having louvers on the outdoor portion in accordance with one or more embodiments of the present disclosure.

DETAILED DESCRIPTION

The present disclosure is generally directed to condensate removal systems and methods for self-contained heat pump room conditioning units (referenced herein as "room conditioning unit" or "unit").

Typical room conditioning units may transfer heat from/to a conditioned space to the environment outside of the conditioned space. In some instances, room conditioning units (e.g., heat pumps or the like) may generate condensate. The systems and methods disclosed herein may be configured to manage the condensate generated by the room conditioning units. For example, the systems and methods disclosed herein may be configured to collect and disperse (by a nozzle or the like) the condensate so as to prevent the condensate from dripping out of the outdoor portion of the conditioning unit, which may also prevent the condensate from forming icicles or ice sheets about the outdoor portion of the conditioning unit.

In certain embodiments, the room conditioning unit can include an outdoor portion. The outdoor portion can be configured to maintain a clean environment within the outdoor portion. For example, the outdoor portion can have an outdoor base pan that can be coated in a non-stick coating, such as Teflon or the like, one or more of the walls of the outdoor portion can include louvers, and/or the outdoor portion can include filters to filter incoming air and prevent the ingress of debris. In some instances, the outdoor portion can include misting systems, which can include one or more nozzles and/or one or more atomizers to discharge water from the outdoor portion as a mist, thereby reducing or eliminating the likelihood that discharged water forms icicles, ice sheets, water streams, or the like. Alternatively, or in addition, the outdoor portion can include discharge valves located at a low point in the outdoor base pan, as well as a catch located below the discharge valves. In some instances, the catch can be configured to receive water when the discharge valves open, and fans located within the catch can force water out of the catch via one or more apertures in the walls of the catch. Further, in certain embodiments, one or more portions of the outdoor portion, such as the outdoor base pan and/or the catch, can include a heat source (e.g., an electric heating element, refrigerant tubing from the heat pump) configured to prevent ice build-up within the outdoor portion.

The room conditioning unit can include an indoor portion having an indoor heat exchanger coil, an outdoor portion having an outdoor heat exchanger coil, and a bridge portion connecting the indoor and outdoor portions being configured to extend across the opening of the building envelope (e.g., across a window sill). In some instances, the room conditioning unit can include one or more condensate removal systems for safely and efficiently discharging condensate that can accumulate during operation of the heat pump. For example, the disclosed condensate removal systems can decrease or eliminate the likelihood that an icicle or ice sheet will form from the condensate on the outdoor portion of the room conditioning unit.

These and other aspects of the present disclosure are described below with reference to the accompanying figures. Other aspects and features of the present disclosure will become apparent to those of ordinary skill in the art upon reviewing the following description of specific examples of the present disclosure in concert with the figures. While features of the present disclosure may be discussed relative to certain examples and figures, all examples of the present disclosure can include one or more of the features discussed herein. Further, while one or more examples may be discussed as having certain advantageous features, one or more of such features may also be used with the various other examples of the disclosure discussed herein. In similar fashion, while examples may be discussed below as devices, systems, or methods, it is to be understood that such examples can be implemented in various devices, systems, and methods of the present disclosure.

Although various aspects of the disclosed technology are explained in detail herein, it is to be understood that other aspects of the disclosed technology are contemplated. Accordingly, it is not intended that the disclosed technology is limited in its scope to the details of construction and arrangement of components expressly set forth in the following description or illustrated in the drawings. The disclosed technology can be implemented and practiced or carried out in various ways. In particular, the presently disclosed subject matter is described in the context of being systems and methods for use with a heat pump water heating system. The present disclosure, however, is not so limited, and can be applicable in other contexts. The present disclosure can, for example, include devices and systems for use with air conditioning systems, refrigeration systems, pool water heat systems, and other similar systems. Furthermore, although described in the context of being a water heater, the disclosed technology can be configured to heat fluids other than water. For example, the disclosed technology can be implemented in various commercial and industrial fluid heating systems used to heat fluids other than water. Accordingly, when the present disclosure is described in the context of a heat pump water heater system, it will be understood that other implementations can take the place of those referred to.

It should also be noted that, as used in the specification and the appended claims, the singular forms "a" "an," and "the" include plural references unless the context clearly dictates otherwise. References to a composition containing "a" constituent is intended to include other constituents in addition to the one named.

Also, in describing the disclosed technology, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, the disclosed technology can include from the one particular value and/or to the other particular value. Further, ranges described as being between a first value and a second value are inclusive of the first and second values. Likewise, ranges described as being from a first value and to a second value are inclusive of the first and second values.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

It is also to be understood that the mention of one or more method steps does not preclude the presence of additional method steps or intervening method steps between those steps expressly identified. Moreover, although the term "step" can be used herein to connote different aspects of methods employed, the term should not be interpreted as implying any particular order among or between various steps herein disclosed unless and except when the order of individual steps is explicitly required. Further, the disclosed technology does not necessarily require all steps included in the methods and processes described herein. That is, the disclosed technology includes methods that omit one or more steps expressly discussed with respect to the methods described herein.

The components described hereinafter as making up various elements of the disclosed technology are intended to be illustrative and not restrictive. Many suitable components that would perform the same or similar functions as the components described herein are intended to be embraced within the scope of the disclosed technology. Such other components not described herein can include, but are not limited to, similar components that are developed after development of the presently disclosed subject matter.

Referring now to the drawings, and particularly to FIGS. 1A-1I, in certain embodiments, a self-contained heat pump room conditioning unit 100 can include an indoor portion 102, an outdoor portion 104, and a bridge portion 106 connecting the indoor portion 102 and the outdoor portion 104. As shown in FIG. 1I, the indoor portion 102 may include an outer facing side 116, lateral sides 110, 112, a top side 114, and an inner facing side 108.

As shown in FIG. 1I, the self-contained heat pump room conditioning unit 100 can house and/or include an indoor heat exchanger coil 118 (also referenced as indoor coil 118) and a blower 120. In some instances, the outdoor portion 104 can include an outdoor heat exchanger coil 122 (also references as outdoor coil 122), a compressor, an expansion valve, and a fan 124. The indoor coil 118, the outdoor coil 122, the compressor (not shown), and the expansion valve (among other components) can be fluidly connected via tubing configured to pass a refrigerant therethrough, thereby forming the self-contained heat pump room conditioning unit 100 which functions as a vapor compression cycle system. While the compressor and/or the expansion valve can be located within the indoor portion 102 or even the bridge portion 106, the self-contained heat pump room conditioning unit 100 is illustrated as having the compressor and the expansion valve located in the outdoor portion 104, which can help reduce noise (and heat output during cooling mode) into the indoor space. The self-contained heat pump room conditioning unit 100 can further include a reversing valve (e.g., a four-way valve, not shown) configured to reverse the flow direction of the refrigerant through the self-contained heat pump room conditioning unit 100, thereby transitioning the self-contained heat pump room conditioning unit 100 between a heating mode, a cooling mode, and/or a defrosting mode.

In certain embodiments, the indoor portion 102 can include an indoor base pan 126. Referring to FIG. 1I in particular, at least a portion of the inner-facing side 108 and/or the lateral sides 110, 112 of the indoor portion 102 can include an air inlet 128 configured to intake air and an air outlet 130 configured to discharge air. The blower 120 can be configured to pull air into the indoor portion 102 via the air inlet 128 and move the air across the indoor coil 118 to effect heat transfer between the refrigerant flowing through the indoor coil 118 and the passing air. The blower 120 can subsequently discharge air into the indoor space via the air outlet 130. In some instances, the indoor base pan 126 can be sloped to bias the flow of condensate to a desired location for subsequent discharge or removal from the indoor base pan 126, which can help reduce the amount of maintenance a user is required to perform.

The outdoor portion 104 can include an outdoor base pan 132, an outer-facing side 134, an inner-facing side 136, opposing lateral sides 138, 139, and a top 140. At least a portion of the inner-facing side 136 and/or one or both of the opposing lateral sides 138, 139 can include louvers 170, 172, which act as air inlets. More so, the outer-facing side 134 of the outdoor portion 104 can include louvers 142 or the like, which act as air outlets. During operation, the fan 124 can be configured to pull air into the outdoor portion 104 via the louvers 170, 172 (or other air inlet(s)), pass the air across the outdoor coil 122 to effect heat transfer between the refrigerant flowing through the outdoor coil 122 and the passing air, and discharge the air via the louver 142 of the outer-facing side 134. In some instances, the outdoor base pan 132 can be sloped to bias the flow of condensate to one or more desired locations for subsequent discharge or removal from the indoor base pan 126. As will be discussed below, a drain valve 148 may be disposed about the outdoor base pan 132. In certain embodiments, the outdoor coil 122 and/or at least some of the fan 124 (e.g., the fan blades) can be located in an outdoor coil housing 144 (e.g., as shown in FIG. 1I), which can help protect the outdoor coil 122 from dirt, which can help improve the heat transferability of the outdoor coil 122 and/or reduce the frequency with which the outdoor coil 122 requires cleaning.

The bridge portion 106 can include insulation to prevent unwanted heat transfer between outdoor and the indoor space. The insulation can also reduce noise and vibration associated with the self-contained heat pump room conditioning unit 100, particularly from the indoor side. The bridge portion 106 can include a pathway for refrigerant tubing, power cables, and/or water pump tubing. In some instances, the bridge portion 106 can be located at or near the top of the indoor portion 102 and the outdoor portion 104 such that the self-contained heat pump room conditioning unit 100 has a generally saddle shape. The room conditioning unit 100 may be any suitable size, shape, or configuration. Accordingly, the self-contained heat pump room conditioning unit 100 can be configured to straddle a window sill or another opening in a building envelope, such as is illustrated in FIGS. 2A and 2B.

In certain embodiments, the width of the outdoor portion 104 and/or the bridge portion 106 can be less than a width of the indoor portion 102. For example, the width of the outdoor portion 104 and/or the bridge portion 106 can be less than the width of a standard window opening, whereas the width of the indoor portion 102 can be greater than or approximately equal to the width of a standard window opening. As specific examples, the outdoor portion 104 and/or the bridge portion 106 can have a width of approximately 20 inches, and the indoor portion 102 can have a width of approximately 26 inches. The bridge portion 106 can have a length sufficiently long to extend across a standard window sill. As a specific example, the bridge portion 106 can have a length of approximately 12 inches. The length of the bridge portion 106 can also serve to separate the inner-facing side 116 of the indoor portion 102 from the wall of the building envelope and/or to separate the inner-facing side 136 of the outdoor portion 104 from the building. The indoor portion 102, the bridge portion 106, and the outdoor portion 104 may be any suitable size, shape, or configuration.

The self-contained heat pump room conditioning unit 100 can include a controller, which can include one or more processors and memory having instructions stored thereon that, when executed by the one or more processors, cause the controller to perform certain methods. For example, the controller can be configured to receive data inputs from a user interface and/or one or more sensors (e.g., temperature sensor(s), humidity sensor(s)) and can be configured to output instructions for certain components to operate. For example, the controller can be configured to output instructions for the compressor, the reversing valve, the fan 124, and/or the blower 120 to operate based at least in part on a current operating mode of the self-contained heat pump room conditioning unit 100 (e.g., heating mode, cooling mode, defrosting mode) and/or received sensor data from one or more of the sensors.

As will be appreciated, condensate can sometimes accumulate within the outdoor portion 104. For example, during heating mode, ice can sometimes accumulate on the outdoor coil 122, which can negatively impact the heating capacity of the self-contained heat pump room conditioning unit 100. Thus, to improve performance, the self-contained heat pump room conditioning unit 100 can be configured to operate in a defrosting mode in which the flow of refrigerant is reversed (as compared to heating mode) such that hot refrigerant can be flowed through the outdoor coil 122 to remove any ice build-up. As the ice melts, the resulting liquid water accumulates in the outdoor base pan 132 and can be eventually discharged or otherwise removed from the outdoor base pan.

In certain embodiments, to help prevent or eliminate the formation of icicles or ice sheets and/or to prevent a substantial flow of water onto the area below the outdoor portion 104, the self-contained heat pump room conditioning unit 100 can include one or more water dispersing mechanisms. In some embodiments, the water dispersing mechanisms may include atomizers or diffusers, a sample of which are indicated as atomizers 302, as depicted in FIG. 3A. The outdoor base pan 132 can be sloped toward one or more apertures, such that condensate can accumulate and drain toward the aperture(s). An atomizer of the one or more atomizers 302 can be located at or within each aperture and/or be in fluid communication with each aperture and the outdoor base pan 132. In certain embodiments, the atomizers 302 can be a piezo atomizer configured to create a fine mist. As such, the self-contained heat pump room conditioning unit 100 can be configured to discharge condensate from the outdoor portion 104 as a fine mist, which can then easily dissipate or be carried away by wind or the exhaust of the outdoor unit. Although two atomizers 302 are shown in FIG. 3A, it is contemplated that one, three, four, or any other number of atomizers 302 can be used. As will be appreciated, it can be beneficial to ensure the water being discharged by the atomizer(s) 302 is clean to help prevent clogging or malfunctioning of the atomizer(s) 302. In this manner, in some instances, to help ensure clean water is being discharged, the outdoor portion 104 can include a water filtration system that intakes water that has accumulated in the outdoor drain pain, filters the water, and passes the filtered water to the atomizer(s) 302. Because the atomizer(s) 302 are configured to discharge small droplets of water, the resulting fine mist can decrease the likelihood for large water droplets and/or streaming water to form and/or for water to accumulate on the underside of the outdoor portion 104. As such, the self-contained heat pump room conditioning unit 100 is less likely to form icicles or ice sheets.

Alternatively, or in addition, the outdoor portion 104 can include a water dispersing mechanism that includes a pump 306 and/or one or more nozzles, a sample of which is indicated as nozzle 304 in FIG. 3B, for discharging a mist. Although the size of water droplets discharged with the nozzle 304 can be larger than the water droplets discharged by the atomizer 302, the benefits can be substantially the same. That is to say, the nozzle 304 can be configured to discharge a fine mist such that the outdoor portion 104 has a decreased likelihood for large water droplets and/or streaming water to form and/or for water to accumulate on the underside of the outdoor portion 104. For example, in certain embodiment, the nozzle 304 may be disposed between the outdoor coil 122 and the fan 124. The pump 306 may be in fluid communication with the outdoor base pan 132 and may pump the condensate from the outdoor base pan 132 to the nozzle 304. The fan 124 may blow the mist existing the nozzle 304 through the outdoor coil 122 and out the louvers 142 on the outer-facing side 134 of the outdoor portion 104. This this manner, the nozzle 304 may be located downstream of the fan 124 and upstream of the outdoor coil 122 relative to an airflow created by the fan 124. In other instances, the nozzle 304 may be located upstream of the fan 124. In yet other embodiments, the nozzle 304 may be disposed equal to or downstream of the outdoor coil 122 such that the nozzle 304 is disposed towards the outside portion of the outdoor coil 122. In this embodiment, the nozzle 304 may spray the condensate on an outside portion of the outdoor coil 122. In certain embodiment, the nozzle 304 may be an atomizer or diffuser.

It should be noted that FIG. 3B additionally illustrates a compressor 308 disposed within the outdoor portion 104.

Alternatively, or in addition, and referring now to FIGS. 4A-4C in particular, the outdoor portion 104 can include one or more drain valves, a sample of which are indicated as a drain valve 402 and a drain valve 404, located at low points in the outdoor base pan 132. For example, the drain valves 402 and 404 can be bellow drain valves, solenoid valves (e.g., in conjunction with a temperature sensor and the controller), or another valve configured to transition between an open state and a closed state depending on a detected temperature. Thus, when the ambient temperature is equal to or greater than a predetermined temperature threshold, such as 40° F., the valve can be closed, thereby retaining water in the outdoor base pan 132. In certain embodiments, to remove water from the outdoor base pan 132 when the temperature is greater than or equal to the predetermined temperature threshold, the fan 124 can be in communication with a slinging ring 406, which can have winglets configured to scoop water from the outdoor base pan 132 and sling the scooped water toward the outdoor coil 122. The water can subsequently escape from the outdoor portion 104 via the louvers 142 on the outer-facing side 134 of the outdoor portion 104, and/or the water can eventually evaporate (e.g., from heat transferred to the water from the refrigerant via the outdoor coil 122). In some instances, the slinging ring 406 may be omitted.

If the ambient temperature is less than the predetermined temperature threshold, the drain valves 402 and 404 can be configured to transition to an open state, thereby permitted water to drain from the bottom of the outdoor base pain 132 and into a catch 410. The catch 410 can be a collector or any other container and can be configured to receive water draining out of the outdoor base pan 132. In certain embodiments, one or more fans, a sample of which is indicated as fan 408 in FIG. 4C, can be configured to turn on when the drain valves 402 and 404 are open, such that the fans, (e.g., the fan 408) can agitate and/or fling the draining water. For example, as shown in in FIG. 4C, in which the catch 410 is illustrated as being transparent to better show the fans, including the fan 156, located within the catch 410, the catch 410 can include one or more apertures, a sample of which is indicated as an aperture 412, (e.g., slots, vents, holes) through which the water can be discharged. That is to say, the fans, including the fan 408, can push the water out of the apertures, and the apertures can be sized to prevent overly large water droplets or streams from forming, thereby reducing the likelihood of, or preventing altogether, the formation of icicles or ice sheets. The apertures can be located on any side of the catch 410, such as some or all of the bottom surface, some or all of the outer-facing surface, some or all of the inner facing surface, and/or some or all of either lateral surface.

As shown in the callout of FIG. 4C, a heat source 414 can be located on or near the fans, for example the fan 408. The heat source 414 can be or include an electric heating element, and/or the heat source 414 can be or include a portion of refrigerant tubing that is connected to the refrigerant circuit of the heat pump such that hot refrigerant can be passed near the fans, for example the fan 408 (e.g., refrigerant leaving the compressor 308). Regardless, the heat source 414 can be configured to output heat whenever the ambient temperature is below the predetermined temperature threshold or a second different predetermined temperature threshold that is less than the predetermined temperature threshold. As will be appreciated, the heat source 414 can be configured to prevent the blades of the fan(s), for example fan 408, from freezing and to help ensure that the water remains in a liquid state until it exits the self-contained heat pump room conditioning unit 100. In some instances, the heat source 414 may be disposed on an upstream side of the fan 408 relative to an airflow created by the fan 408. In this manner, the fan 408 may blow heated air towards the condensate within the catch 410. In some instances, the catch 410 may be omitted, and the heat source 414 and fan 408 may be disposed within the outdoor base pain 132 and may blow heated air on the condensate therein.

Alternatively, or in addition, a heat source 416 can be routed to conform to at least some of the outdoor base pan 132. The heat source 416 can thus be configured to apply heat to water located in the outdoor base pan 132. As will be appreciated, the slinging ring 406 is configured to scoop water but does not remove all water from the outdoor base pan 132. As such, there can be some amount of water that remaining within the outdoor base pan 132. The heat source 166 can thus prevent the accumulated water from freezing within the outdoor base pan 132. The heat source 416 can be the same or different from the heat source 414. That is to say, the heat source 416 can be or include an electric heating element, and/or the heat source 416 can be or include a portion of refrigerant tubing that is connected to the refrigerant circuit of the heat pump such that hot refrigerant can be passed near the fans, including the fan 156, (e.g., refrigerant leaving the compressor 306).

As mentioned herein, it can be beneficial to keep the internal components of the outdoor portion 104 as clean as possible. This can, for example, help ensure reliable functionality of the water discharge system, whether it be via atomizers 302, nozzles, including nozzle 304, or any other mechanism.

To help maintain cleanliness inside the outdoor portion 104, the self-contained heat pump room conditioning unit 100 can include one or more filters, a sample of which is indicated as filters 602 and 604, such as those illustrated in FIGS. 6A and 6B. The filters, for example filters 602 and 604, can be configured to fit in the internal volume of the outdoor portion 104. For example, the filters, for example the filters 602 and 604, can be sized and shaped to conform to some or all of the inner surface of the inner-facing side 136 of the outdoor portion 104 and/or the inner surface of either of the lateral sides 138, 139. Alternatively, or in addition, the filters, including the filters 602 and 604, can be sized and shaped to conform to some or all of the outer surface of the inner-facing side 136 of the outdoor portion 104 and/or the outer surface of either of the lateral sides 138, 139. That is to say, the filters, including the filters 602 and 604, can be configured to cover or substantially cover the various air inlets of the outdoor portion 104. In certain embodiments, the filters, including the filters 602 and 604 can be removeable by removing the filters from the exterior of the outdoor portion 104 and/or by lifting the top 140 of the outdoor portion 104 and removing the filters from inside the outdoor portion 104. The filters, including the filters 602 and 604, can be washable and reusable, or the filters, including the filters 602 and 604, can be single-use filters.

Referring to FIGS. 7A-7C, the outdoor portion 104 can include louvers on one or more external surfaces. The louvers may form and/or be disposed about the air inlets of the outdoor portion 104. For examples, louvers can be located along some or all of the inner-facing side 136 of the outdoor portion 104 and/or the either of the lateral sides 138, 139. A sample of such louvers include louvers 702 on the lateral side 138, 139 and louvers 704 on the inner-facing side 136. The louvers 702 and 704 may act as air inlets into the outdoor portion 104. For example, the fan 124 may create an airflow within the outdoor portion 104 from the air inlets to the air outlet 142 on the outer-facing side 134. In certain embodiments, the louvers 702 and 704 can extend horizontally and can be downward facing to form an overhang about an opening in the wall of the outdoor portion 104, which can permit the ingress of air while preventing the ingress of water and/or debris. In this manner, as shown in FIGS. 7A and 7B, water can impact the outer surface of the louvers and deflect or flow downwardly, wherein air can enter into the outdoor portion 104 via the apertures formed by the louvers, as shown in FIG. 7C.

As noted above, the filters 602 and 604 can be disposed within the interior of the outdoor portion 104 and can be configured to cover or substantially cover the various air inlets of the outdoor portion 104. In this manner, all or a majority of the air flowing into the louvers 702 and 704 (i.e., air inlets) of the outdoor portion 104 may be filtered by the filters 602 and 604.

Alternatively, or in addition, the outdoor base pan 132 can include a non-stick coating. For example, some or all of the outdoor base pan 132 can be coated in polytetrafluoroethylene, e.g., Teflon®, or a similar material. Such coatings can help promote a cleaner environment within the outdoor portion 104, as it can be more difficult for dirt, grime, and debris to stick to the outdoor base pan 132 (e.g., as compared to the outdoor base pan 132 without such a coating). Further, polytetrafluoroethylene has a high chemical compatibility with plastic materials, has high abrasion resistance, has a large operating temperature range, and is compatible with many coil cleaning materials. A non-stick coating on the outdoor base pan 132 can promote discharge of water or other liquids due to the beading effect associated with water on a non-stick coating. Polytetrafluoroethylene and other non-stick coatings also have a low thermal conductivity and thermal diffusivity, which can reduce the likelihood of water refreezing while it located on the outdoor base pan 132 before being discharged, and the effective conduction area of a water droplet on the non-stick coating is less (as compared to the outdoor base pan 132 without such a coating) due to the beading effect.

Exemplary Embodiments

Embodiment 1. An air conditioning unit for use in an opening of a building, the air conditioning unit comprising: an indoor portion configured to be position on an internal portion of the building and having an indoor heat exchanging coil; an outdoor portion configured to be position on an external portion of the building and having an outdoor heat exchanging coil; and a water dispensing mechanism comprising a nozzle configured to externally disperse condensate from within the outdoor portion.

Embodiment 2. The air conditioning unit of embodiment 1, wherein the outdoor portion comprises a fan configured to provide external airflow out of the outdoor portion, and wherein the nozzle is configured to spray the condensate such that the fan disperses the condensate in the external airflow out of the outdoor portion.

Embodiment 3. The air conditioning unit of embodiment 1 or 2, wherein the nozzle is disposed about the outdoor heat exchanging coil.

Embodiment 4. The air conditioning unit of any one of embodiments 1 to 3, wherein the fan comprises a slinging ring.

Embodiment 5. The air conditioning unit of any one of embodiments 1 to 4, wherein the outdoor portion includes a base pan and/or catch configured to collect the condensate, and wherein the water dispensing mechanism comprises a pump configured to pump the condensate to the nozzle.

Embodiment 6. The air conditioning unit of any one of embodiments 1 to 5, wherein the water dispensing mechanism comprises a heat source and a fan, and wherein the heat source is configured to heat air that the fan blows about the condensate in the base pan.

Embodiment 7. The air conditioning unit of any one of embodiments 1 to 6, wherein the heat source is disposed on an upstream side of the fan relative to an airflow created by the fan.

Embodiment 8. The air conditioning unit of any one of embodiments 1 to 7, wherein the outdoor portion comprises downward facing louvers configured to prevent ingress of debris into the outdoor portion.

Embodiment 9. The air conditioning unit of any one of embodiments 1 to 8, wherein the outdoor portion comprises a filter disposed about the downward facing louvers.

Embodiment 10. The air conditioning unit of any one of embodiments 1 to 9, wherein the nozzle comprises an atomizer.

Embodiment 11. The air conditioning unit of any one of embodiments 1 to 10, wherein the water dispensing mechanism is disposed within the outdoor portion.

Embodiment 12. An air conditioning unit for use in an opening of a building, the air conditioning unit comprising: an indoor portion configured to be position on an internal portion of the building and having an indoor heat exchanging coil; an outdoor portion configured to be position on an external portion of the building and having an outdoor heat exchanging coil; and a water dispensing mechanism configured to externally disperse condensate from within the outdoor portion, wherein the outdoor portion includes a base pan and/or catch configured to collect the condensate, wherein the water dispensing mechanism comprises a heat source and a fan, and wherein the heat source is configured to heat air that the fan blows about the condensate in the base pan.

Embodiment 13. The air conditioning unit of embodiment 12, wherein the heat source is disposed on an upstream side of the fan relative to an airflow created by the fan.

Embodiment 14. The air conditioning unit of embodiment 12 or 13, wherein the fan comprises a sling ring configured to scoop water from the base pan and/or catch.

Embodiment 15. The air conditioning unit of any one of embodiments 12 to 14, wherein the outdoor portion comprises the fan, which is configured to provide external airflow out of the outdoor portion, and wherein the water dispensing mechanism comprises a nozzle configured to spray the condensate within the outdoor portion such that the fan disperses the condensate in the external airflow out of the outdoor portion.

Embodiment 16. The air conditioning unit of any one of embodiments 12 to 15, wherein the water dispensing mechanism comprises a pump configured to pump the condensate out of the base pan and/or catch.

Embodiment 17. The air conditioning unit of any one of embodiments 12 to 16, wherein the outdoor portion further comprises louvers configured to prevent ingress of debris into the outdoor portion.

Embodiment 18. The air conditioning unit of any one of embodiments 12 to 17, wherein the outdoor portion further comprises a filter configured to filter particles from an airflow into the outdoor portion.

Embodiment 19. The air conditioning unit of any one of embodiments 12 to 18, wherein the water dispensing mechanism comprises an atomizer configured to disperse a mist from the condensate and out of the air conditioning unit.

Embodiment 20. The air conditioning unit of any one of embodiments 12 to 19, wherein the water dispensing mechanism is disposed within the outdoor portion.

Embodiment 21. An air conditioning unit for use in an opening of a building, the air conditioning unit comprising: an indoor portion configured to be position on an internal portion of the building and having an indoor heat exchanging coil; and an outdoor portion configured to be position on an external portion of the building and having an outdoor heat exchanging coil, wherein the outdoor portion comprises an air inlet comprising downward facing louvers configured to prevent ingress of debris into the outdoor portion, and wherein an interior of the outdoor portion comprises a filter disposed about the downward facing louvers.

Embodiment 22. An air conditioning unit comprising the combination of any one of embodiments 1 to 21.

While the present disclosure has been described in connection with a plurality of exemplary aspects, as illustrated in the various figures and discussed above, it is understood that other similar aspects can be used, or modifications and additions can be made to the described subject matter for performing the same function of the present disclosure without deviating therefrom. In this disclosure, methods and compositions were described according to aspects of the presently disclosed subject matter. But other equivalent methods or compositions to these described aspects are also contemplated by the teachings herein. Therefore, the present disclosure should not be limited to any single aspect, but rather construed in breadth and scope in accordance with the appended claims.

Moreover, the various diagrams and figures presented herein are for illustrative purposes and are not to be considered exhaustive. That is, the systems described herein can include one or more additional components, such as various valves, expansions tanks, and the like, as will be appreciated by one having ordinary skill in the art.

That which is claimed is:

1. An air conditioning unit for use in an opening of a building, the air conditioning unit comprising:

an indoor portion configured to be positioned within an internal portion of the building and having an indoor heat exchanging coil;

an outdoor portion configured to be positioned about an external portion of the building and having an outdoor heat exchanging coil; and a water dispensing mechanism comprising a nozzle configured to externally disperse condensate from within the outdoor portion, wherein the outdoor portion includes a base pan and/or catch configured to collect the condensate, wherein the water dispensing mechanism comprises a pump configured to pump the condensate to the nozzle, wherein the water dispensing mechanism comprises a heat source and a fan, and wherein the heat source is configured to heat air that the fan blows about the condensate in the base pan.

2. The air conditioning unit of claim 1, wherein the outdoor portion comprises a fan configured to provide external airflow out of the outdoor portion, and wherein the nozzle is configured to spray the condensate such that the fan disperses the condensate in the external airflow out of the outdoor portion.

3. The air conditioning unit of claim 2, wherein the nozzle is disposed about the outdoor heat exchanging coil.

4. The air conditioning unit of claim 2, wherein the fan comprises a slinging ring.

5. The air conditioning unit of claim 1, wherein the heat source is disposed on an upstream side of the fan relative to an airflow created by the fan.

6. The air conditioning unit of claim 1, wherein the outdoor portion comprises downward facing louvers configured to prevent ingress of debris into the outdoor portion.

7. The air conditioning unit of claim 1, wherein the nozzle comprises an atomizer.

8. The air conditioning unit of claim 1, wherein the water dispensing mechanism is disposed within the outdoor portion.

9. An air conditioning unit for use in an opening of a building, the air conditioning unit comprising:

an indoor portion configured to be positioned within an internal portion of the building and having an indoor heat exchanging coil;

an outdoor portion configured to be positioned about an external portion of the building and having an outdoor heat exchanging coil; and a water dispensing mechanism configured to externally disperse condensate from within the outdoor portion, wherein the outdoor portion includes a base pan and/or catch configured to collect the condensate, wherein the water dispensing mechanism comprises a heat source and a fan, and wherein the heat source is configured to heat air that the fan blows about the condensate in the base pan.

10. The air conditioning unit of claim 9, wherein the heat source is disposed on an upstream side of the fan relative to an airflow created by the fan.

11. The air conditioning unit of claim 9, wherein the fan comprises a sling ring configured to scoop water from the base pan and/or catch.

12. The air conditioning unit of claim 9, wherein the outdoor portion comprises the fan, which is configured to provide external airflow out of the outdoor portion, and wherein the water dispensing mechanism comprises a nozzle configured to spray the condensate within the outdoor portion such that the fan disperses the condensate in the external airflow out of the outdoor portion.

13. The air conditioning unit of claim 9, wherein the water dispensing mechanism comprises a pump configured to pump the condensate out of the base pan and/or catch.

14. The air conditioning unit of claim 9, wherein the outdoor portion further comprises louvers configured to prevent ingress of debris into the outdoor portion.

15. The air conditioning unit of claim 14, wherein the outdoor portion further comprises a filter configured to filter particles from an airflow into the outdoor portion.

16. The air conditioning unit of claim 9, wherein the water dispensing mechanism comprises an atomizer configured to disperse a mist from the condensate and out of the air conditioning unit.

17. The air conditioning unit of claim 9, wherein the water dispensing mechanism is disposed within the outdoor portion.

* * * * *